United States Patent [19]

Drago

[11] Patent Number: 4,895,191

[45] Date of Patent: Jan. 23, 1990

[54] METHOD AND APPARATUS FOR FILLING OPEN MOUTHED CONTAINERS BY PASSING SAID CONTAINERS BENEATH A SUB-LAMINAR SHEET OF FALLING LIQUID

[76] Inventor: Robert J. Drago, 37 Kenton Pl., Hamburg, N.Y. 14075

[21] Appl. No.: 347,515

[22] Filed: May 4, 1989

[51] Int. Cl.[4] ..... B65B 3/26

[52] U.S. Cl. ..... 141/1; 141/131; 141/132; 141/168

[58] Field of Search ..... 141/1, 131, 132, 133, 141/134, 168

[56] References Cited

U.S. PATENT DOCUMENTS 2,667,424 1/1954 Martin ..... 141/132 X 2,785,707 3/1957 Ryan, Jr. et al. ..... 141/1

4,103,720 8/1978 Eisenberg ..... 141/1

4,495,974 1/1985 Pohorski ..... 141/132

*Primary Examiner*—Ernest G. Cusick

*Attorney, Agent, or Firm*—Sommer, Oliverio & Sommer

[57] ABSTRACT

Apparatus (10) for filling containers, such as can (C), has a tank (14) provided with a weir (30) over which liquid may fall and descend along a guide plate (32). The liquid falls from the guide plate as a sub-laminar rectangular sheet having, in transverse cross-section, a width (w) and a length (l). An endless stream of single-file series-abutting cans is moved beneath the guide plate, and through the length of the falling liquid sheet. Each can is just filled with liquid as it is moved the length of the liquid sheet, but without undue splashing of liquid or contamination of the can outer surfaces.

11 Claims, 4 Drawing Sheets

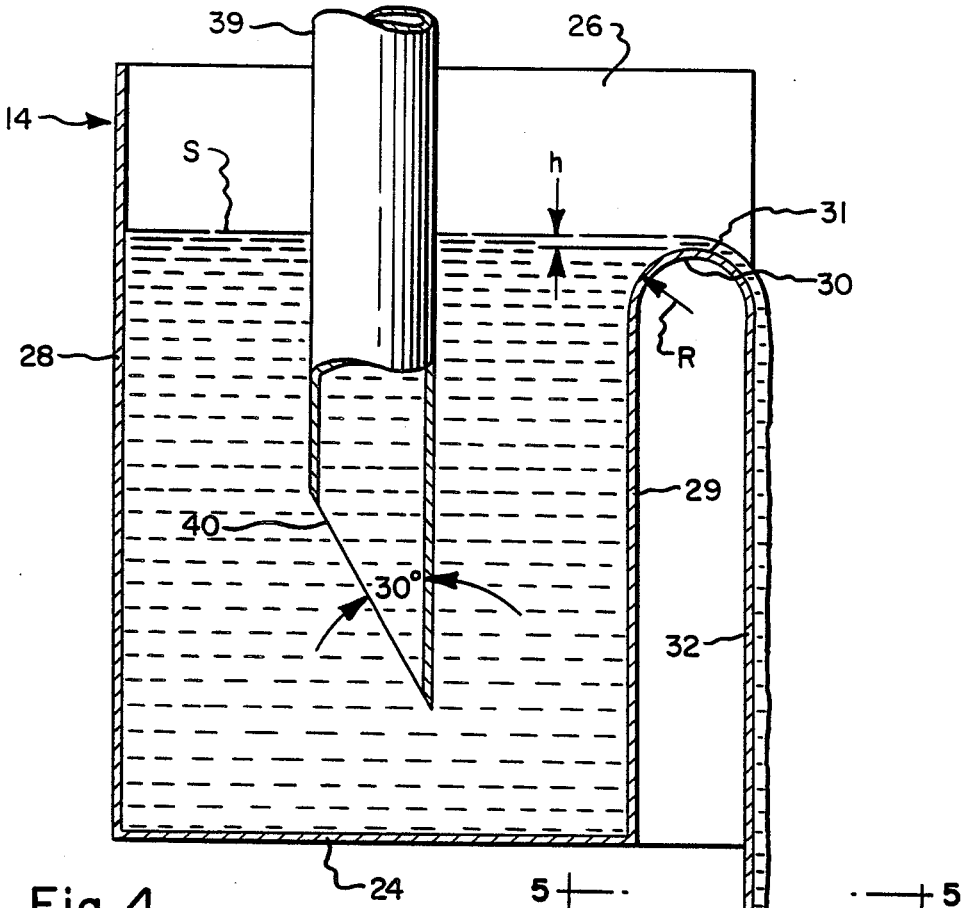
Fig. 4.
Fig. 5.
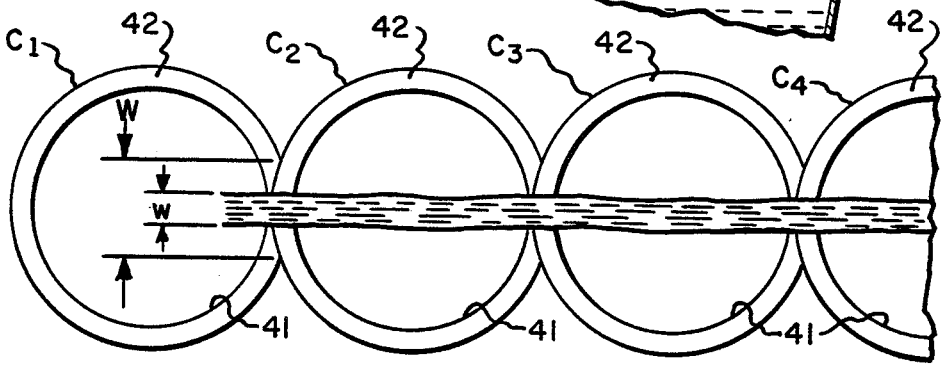

METHOD AND APPARATUS FOR FILLING OPEN MOUTHED CONTAINERS BY PASSING SAID CONTAINERS BENEATH A SUB-LAMINAR SHEET OF FALLING LIQUID

TECHNICAL FIELD

The present invention relates generally to a method and apparatus for filling containers with various liquids, and, more particularly, to an improved method and apparatus for filling a plurality of series-abutting containers by passing a single-file moving row of such containers under a continuous laminar flow of falling liquid in such a manner that each of the containers will be just filled with the liquid to the desired depth as they travel beneath the length of such liquid, but without contaminating the outer surfaces thereof with such liquid.

BACKGROUND ART

In the canning industry, it is often desired to fill a can with liquid. The liquid may constitute the sole contents of the can (e.g., broth, juice and the like), or may be in the form of a brine or sauce to cover other food products placed therein.

Heretofore, it has been known to fill such cans individually by positioning a discharge nozzle in the open mouth of the can, and then discharging a measured amount of fluid therein.

U.S. Pat. No. 4,103,720 appears to disclose a device for filling containers by passing a continuous moving single-file row of series-abutting containers under a continuous stream of falling liquid. Liquid is supplied to a tank, is caused to overflow a weir, and descends along an inclined path in the form of a continuous falling sheet of liquid. A row of juxtapositioned open-top containers (i.e., cans, bottles or the like) are moved beneath the plate, and are caused to translate the length of the liquid sheet. Thus, containers are filled with liquid as they are moved beneath the sheet. However, this patent specifically contemplates that the containers should be deliberately overfilled with liquid, and that air jets be directed at or around the outer surface of the container immediately below its open mouth. The avowed purpose of these air jets is to direct and deflect overflowing liquid away from the cans so as to avoid contaminating the outer surfaces thereof with excess liquid.

While this system may provide a means for filling containers, it has been Applicant's experience that it involves unnecessary structure or steps, namely, that the air jets and the function thereof can be eliminated altogether if the falling liquid sheet is appropriately sized with respect to the containers, and if the translational speed of the containers is appropriately related to the transverse cross-sectional dimensions of the liquid sheet.

DISCLOSURE OF THE INVENTION

The present invention provides, in one aspect, an improved machine for filling containers with a falling laminar sheet of liquid and which avoids contaminating the outer surfaces of the containers with liquid, which machine broadly comprises: a source of liquid; a pump for supplying liquid from said source at a controllable flow; a tank arranged to be supplied with liquid from the pump, the tank having a weir over which liquid may flow and having a guide plate arranged to guide the descent of liquid overflowing the weir, the guide plate having an upper end connected to the weir and having a lower end, the flow of liquid being so controlled with respect to the configuration of the weir and plate that liquid overflowing the weir will descend along the guide plate and fall from the plate lower end as a continuous sub-laminar rectangular sheet having a substantially-constant transverse cross-sectional width and length; and container moving means for selectively moving a plurality of series-abutting open-mouthed containers beneath the plate lower end and along the length of the liquid sheet, the translational speed of the containers being such that the containers are just filled with liquid to the desired depth as the containers are translated along the length of the sheet, but without liquid contaminating the outer side surfaces of the containers.

In another aspect, the invention provides an improved method of filling a plurality of juxtapositioned moving containers with liquid to a desired depth without contaminating the outer surface of the containers with the liquid, which method comprises the steps of: forming a plurality of open-mouthed containers, each of said containers having an outwardly-extending flange about its open mouth; arranging said containers in a series-abutting row such that the flange portions of any two adjacent containers will be overlapped with respect to one another; providing a flow of liquid as falling laminar sheet having a substantially-rectangular transverse cross-section; and moving such series-abutting cans beneath the sheet such that each container will be just filled with said liquid to the desired depth, but without contaminating the outer surface of the container.

Accordingly, the general object of this invention is to provide an improved machine for filling variously-sized and -shaped containers with liquid.

Another object is to provide an improved container-filling machine in which a moving single-file row of series-abutting containers is caused to pass beneath a falling sheet of liquid in such a manner that each container is just filled with liquid as it is moved along the length of the sheet.

Another object is to provide an improved container-filling machine in which a row of series-abutting containers is passed beneath a falling sheet of liquid such that the containers will be just filled to the desired depth as they translate the length of the fluid sheet, without the need for external air jets to blow off excess liquid and without contaminating the outer surface of such containers with excess liquid or spillage.

Still another object is to provide an improved method and apparatus for filling containers with liquid by passing a moving single-file row of such containers beneath a falling laminar sheet of liquid in such a manner that each of the cans is just filled with liquid after passing beneath, and moving the length of, the liquid sheet, and, more specifically, to eliminate the need for air jets to blow off excess liquid from the containers.

These and other objects and advantages will become apparent from the foregoing and ongoing written specification, the drawings, and the appended claims.

BRIEF DESCRIPTION OF THE DRAWINGS

FIG. 4 is a fragmentary transverse vertical sectional view thereof, taken generally on line 4—4 of FIG. 2, showing the tank and weir in transverse cross-section, this view also showing liquid as overflowing the weir and descending along the plate to fall into the open mouths of containers passing therebeneath.

FIG. 5 is a fragmentary horizontal sectional view, taken generally on 5—5 of FIG. 4, showing the position of the liquid sheet in relation to a plurality of series-abutting cans passing therebeneath.

MODE(S) OF CARRYING OUT THE INVENTION

Figure 1:
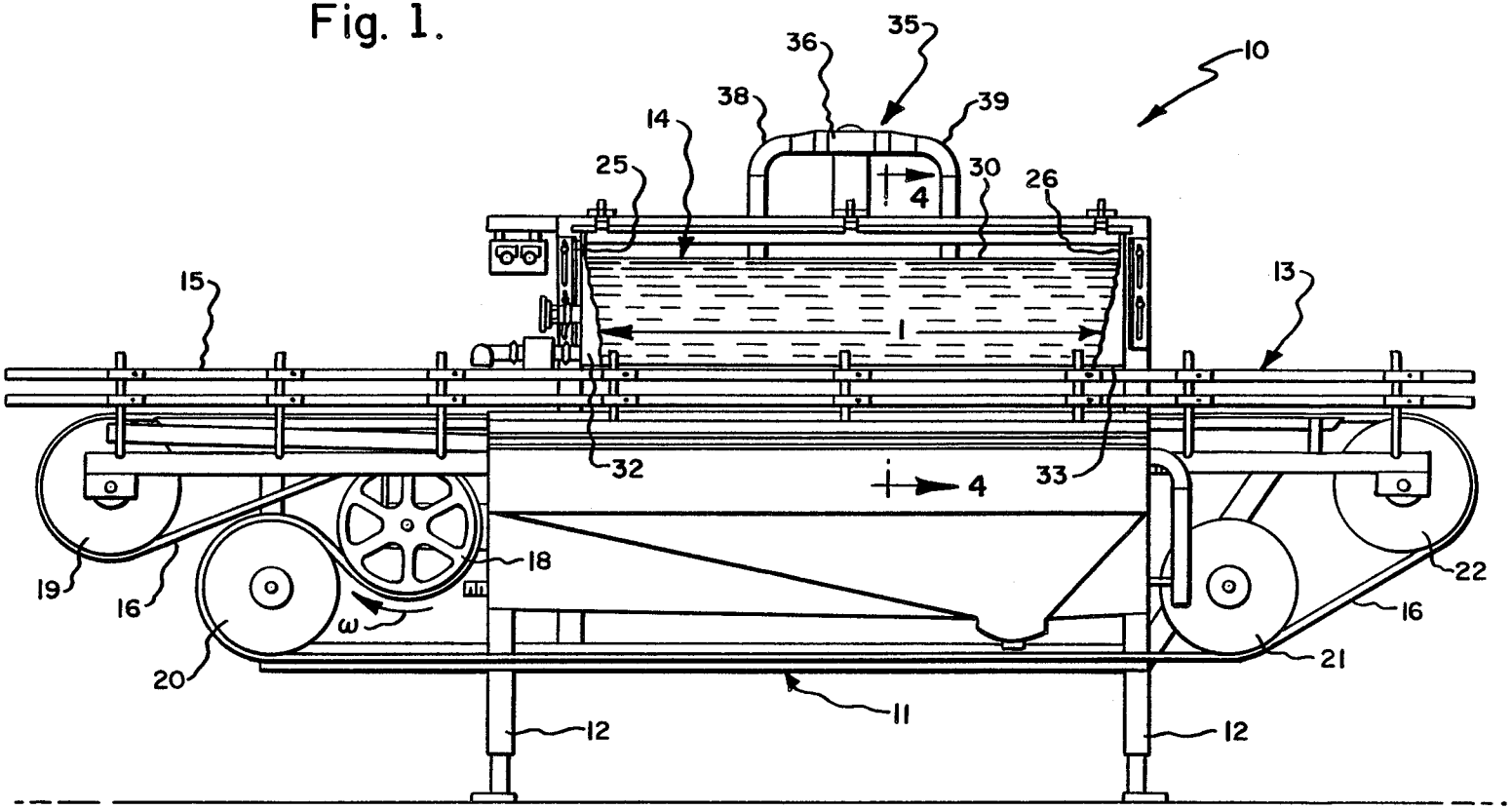
FIG. 1 is a front elevational view of an improved can-filling machine, showing the liquid as overflowing the weir and descending along the guide plate, and also showing the conveyor.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. The drawings are intended to be read (e.g., arrangement of parts, mounting, orientation, etc.) together with the specification and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.) simply refer to the orientation of the illustrated structure as the particular drawing figure faces the reader. Unless otherwise indicated, the terms "inwardly" and "outwardly" simply refer to the orientation of a surface relative to its axis of elongation, or axis of rotation, as appropriate.

Referring now to the drawings, and, more particularly, to FIGS. 1–4 thereof, this invention broadly provides improved apparatus, of which the presently-preferred embodiment is generally indicated at 10, for filling a plurality of containers with liquid.

As used herein, the term "liquid" is intended to encompass conventional relatively incompressible fluids (e.g., water, brines, broths, and the like) having typical fluid properties such as density ($\rho$), viscosity or resistance to flow ($\mu$), and the like, as well as various more-viscous generally-homogeneous liquids containing entrained or suspended solids (e.g., tomato juices, tomato sauces, etc.) having liquid-like properties and characteristics. The term "container" is similarly intended in a broad generic sense, and specifically includes a variety of cans, whether formed of metal or not, glassware, plastics, bowls, bottles and the like. Thus, while the present apparatus will be described with respect to filling various cans with water, persons skilled in this art will immediately appreciate that this is illustrative only, and that such liquid constitutes only one particular species of a much broader class of liquids, and that such can is merely one example of a broader class of containers.

Turning now to FIGS. 1–4, the improved apparatus is shown as including a frame 11 supported by a plurality of legs, severally indicated at 12. A horizontal conveyor, generally indicated at 13, is mounted on a table-top portion of the frame for translating a plurality of cans, severally indicated at C and individually indicated by appropriate subscripts (i.e., $C_1$, $C_2$, $C_3$, . . . , $C_n$) past a tank 14. A pair of transversely-spaced longitudinally-extending guide rails 15,15 are shown as extending from left to right (FIG. 1) to guide the translational movement of a continuous single-file stream or row of series-abutting open-mouth cans beneath the tank.

Figure 3:
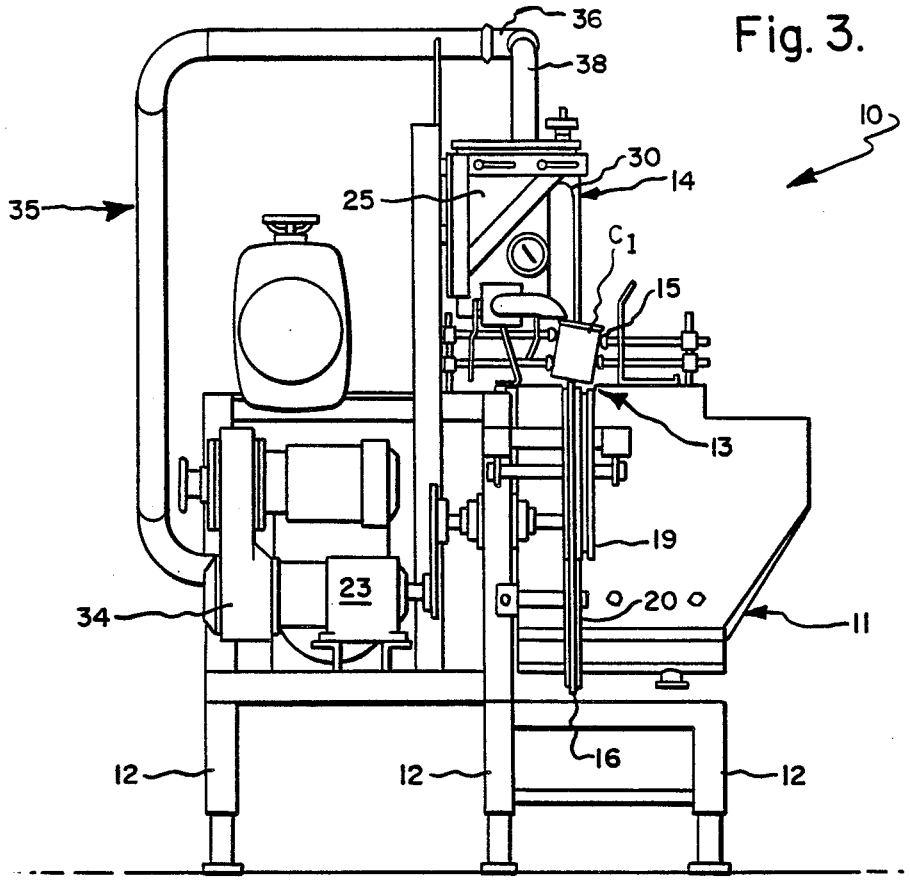
FIG. 3 is a left end elevational view of the machine shown in FIG. 1, with a can shown as being positioned beneath the guide plate.
Figure 6:
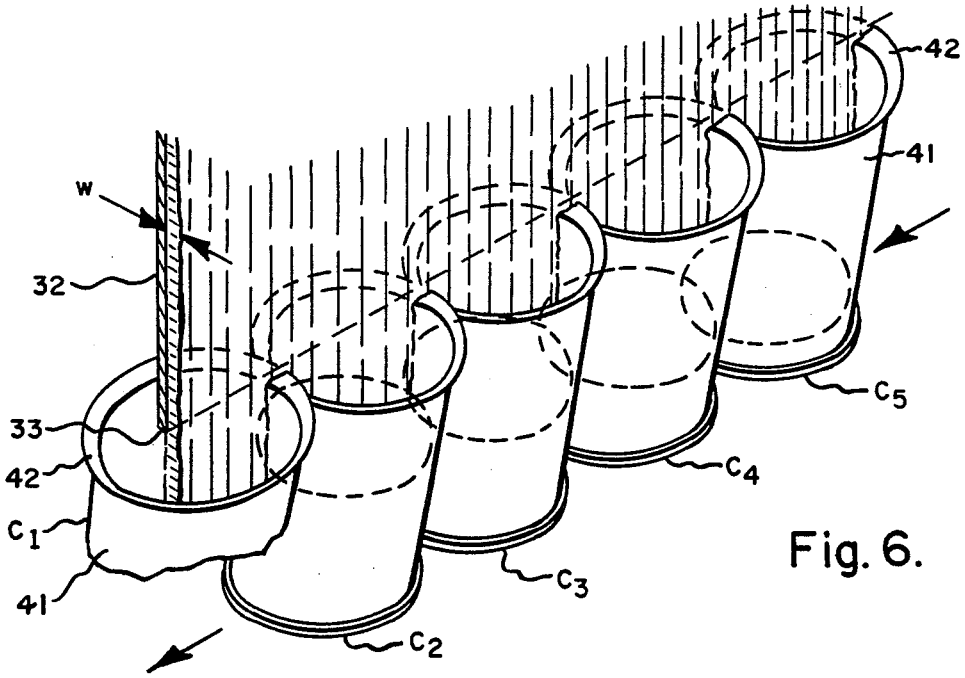
FIG. 6 is a perspective view of the falling sheet and cans shown in FIG. 5, this view also depicting the individual cans as being filled to different depths, depending upon their positions at that point in time with respect to the falling stream.

An endless Teflon®-coated cable 16 is shown as being passed around a driving roller 18 and a plurality of freely-rotatable driven or idler rollers 19,20,21,22, respectively, each of which is suitably journalled on the frame. As best shown in FIG. 3, driving roller 18 is arranged to be rotated at an adjustable and controllable angular speed ($\omega$by means of a motor 23 mounted on the frame and engaging the driving roller through a belt-and-pulley. Since the angular speed of driving roller 18 may be selectively varied, the surface speed of cable 16 may be concomitantly varied. In the disclosed embodiment, pulley 18 is rotated in the direction of arrow $\omega$ (i.e., clockwise in FIG. 1) so that cans entering the rightward approach end of the conveyor from other structure (not shown) will be translated horizontally leftwardly therealong as a continuous single-file row or stream of series-abutting cans toward the leftward exit end of the conveyor. Rails 15,15 are provided to prevent undesired lateral movement of the cans. The horizontal speed of the cans themselves is controlled by a suitable means (not shown). The horizontal speed of cable 16 is preferably slightly greater than the actual horizontal speed of the cans themselves so that the effect of such positive relative speed of the cable with respect to the cans (i.e., slippage of the cable beneath the cans) will be to keep the cans in abutting relation to one another. Thus, such relative motion will continuously act to close up any space between adjacent cans, with the cable being free to slip relative to the cans in the absence of such spacing. Thus, an endless stream of cans is translated along the horizontal length of the conveyor, with the greater speed of the cable insuring that each can will abut its immediate fore and aft neighbors.

Figure 2:
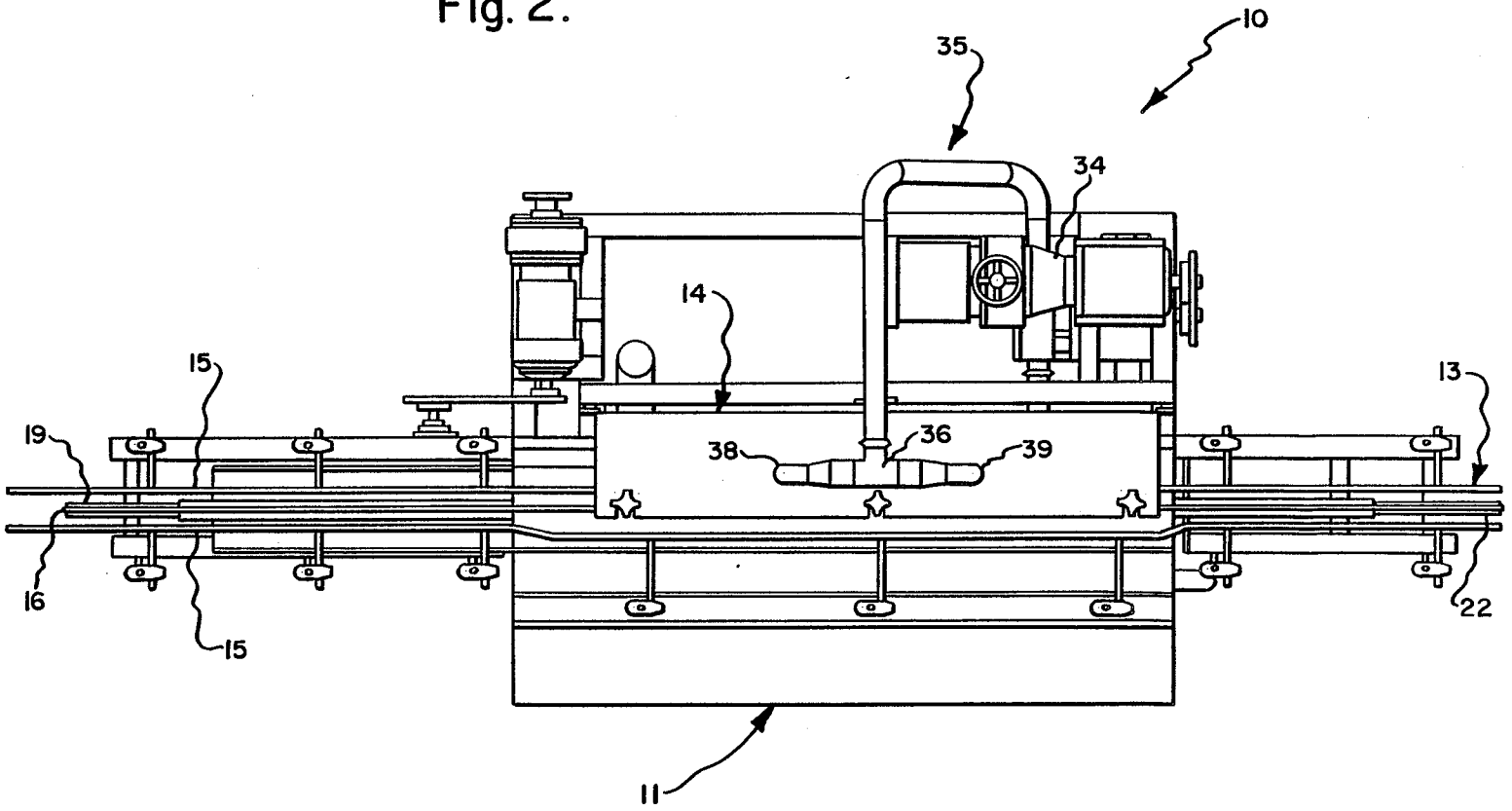
FIG. 2 is a top plan view of the machine shown in FIG. 1.

As best shown in FIGS. 1, 2 and 4, tank 14 is generally-rectangular and is horizontally-elongated in the direction of the conveyor (i.e., from left-to-right in FIG. 1). The tank has a horizontal planar bottom 24, a planar vertical left end wall 25, a planar vertical right end wall 26, a planar vertical rear wall 28, and a planar vertical front wall 29. The adjacent marginal edges of the bottom and the four upstanding side walls are appropriately joined together, as by welding or the like, to define an opentop substantially-rectangular box-like structure. As best shown in FIG. 4, the upper margin of front wall 29 is configured as a horizontally-elongated rounded suppressed weir 30, which extends the length of the tank between its left and right walls 25, 26, respectively.

More particularly, the weir is formed by an elongated sheet of metal which is bent or rolled to have a semi-cylindrical outer surface 31 of radius R. As best shown in FIG. 4, the left margin of weir 30 tangentially joins the upper margin of front wall 29. The right margin of weir 30 tangentially joins a horizontally-elongated substantially-vertical guide plate 32. Front wall 29, weir 30 and guide plate 32 may be formed integrally (as shown), or separately and subsequently assembled together, as desired. In the preferred embodiment, the radius (R) of weir surface 31 is about 1.0 inches (2.54 cm).

Still referring principally to FIG. 4, the longitudinally-extending lower edge 33 of the guide plate is positioned below tank bottom 24. This lower edge should be positioned immediately above the mouths of the cans passing therebeneath. The principal function of guide plate 32 is to guide the descent of liquid overflowing weir 30 toward the open mouths of the cans being translated therebeneath. The length of the tank and weir may be readily varied. Indeed, this dimension is largely a function of the flow, and the speed and volume of the containers.

Referring now to FIGS. 1–4, pump 34 is arranged to supply liquid from a suitable source (not shown) to tank 14 via a conduit, generally indicated at 35, having a Tee 36 and two branch passages 38,39. In FIG. 4, the lower margin of branch conduit 39 is shown as having an elliptical opening 40, which is formed by cutting the lower end of the conduit to have an acute included angle of about 30° with respect to the vertical axis of conduit 39. Conduit 38 is similarly configured. Pump 34 is arranged to provide a controllable non-pulsating flow of liquid through conduit 35 and branch conduits 38,39 to the tank. Moreover, pump 34 is adjustable to supply to tank 14 a flow of liquid to replenish the liquid overflowing the weir. In effect, the surface S of the liquid in tank 14 may be regarded as being spaced slightly above the crest of weir 30 by a distance h so that the surface velocity of liquid approaching the weir will be relatively slow. Pump 34 is arranged to supply a sufficient flow of liquid to the tank so that, in steady state, the flow of liquid into the tank will equal that overflowing the weir. Hence, the height of the liquid surface above the crest of the weir (i.e., dimension h in FIG. 4) will remain substantially constant. Because of this, the liquid approach surface velocity will also remain substantially constant during steady state operation. The volume of tank 14 should be sufficiently large so that the replacement flow entering the tank via branch conduits 38,39 will be substantially quiescent (i.e., non-boiling) in order that the turbulence of such flow into the tank will not substantially disturb the surface velocity of the liquid as it approaches the weir.

The flow supplied to the tank is selected and controlled so that the flow of fluid overflowing the weir and descending along the guide plate will be substantially sub-laminar. As used herein, "sub-laminar" means that such descending flow along the guide plate will be substantially less than the particular flow occurring at the interface between laminar and turbulent flow. Persons skilled in this art will readily appreciate that the surface velocity of liquid in the tank as it approaches the weir, will be substantially horizontal. The radius of curvature of weir surface 31 is selected so that the horizontal approach velocity is low enough so that the streamlines of liquid overflowing the weir, remain substantially parallel to weir outer surface 31 as liquid overflows the weir, and remains substantially parallel to the guide plate (i.e., vertical) as the liquid descends therealong. In other words, the weir is so dimensioned and proportioned with respect to the flow, that liquid overflowing the weir does not inertially separate from weir outer surface 31. Hence, the flow over the weir, as well as the descending flow along the guide plate, is substantially sub-laminar. The significance of this is that liquid overflowing the weir will descend along the guide plate substantially as a sub-laminar sheet. This sheet has, in transverse cross-section, a width (w) and an length (l). This sheet is depicted as having a somewhat trapezoidal outline or profile, when viewed in front elevation (FIG. 1). Moreover, because plate 32 is vertical, and the flow therealong is sub-laminar, the sheet separates cleanly and inertially from the lower plate edge 33, as shown in FIG. 4. Hence, there is no Coanda effect[1], and hence no need for a specially-configured drip edge at the bottom of the guide plate, as in U.S. Pat. No. 4,103,720.

[1]The tendency of a fluid to follow the wall contour when discharged adjacent to a surface, even when that surface curves away from the axis of the discharge, is known as the "Coanda effect".

As best shown in FIGS. 4 and 5, the open-mouthed cans C severally have a cylindrical side wall structure 41 and, at their upper ends, have an out-turned annular flange 42 surrounding the open mouth. Each flange is shown as having an upwardly- and inwardly-facing frusto-conical shape, although it may extend radially outwardly as a flat annular ring in some instances. Thus, when the cans are caused to abut one another, as shown in FIG. 5, the flanges of adjacent cans will overlap one another. Whether the flange of a particular can is arranged above or below the flange of its fore and aft neighboring cans, is unimportant. However, it is important that the flanges of adjacent cans be overlapped. In FIG. 5, the flanges of adjacent cans are shown as being overlapped by a dimension W, this being measured transversely with respect to the direction of can movement.

In the presently-preferred embodiment, the width (w) of the falling liquid sheet is controlled so as to be about one-third of the extent of flange overlap (W), with the midpoint of the width of the falling sheet being substantially aligned with the moving centerlines of the cans. Since the cans are biased to continuously abut one another by slippage of the cable therebeneath, the descending sheet of liquid will fall directly into the cans, except such portions thereof as may strike or impinge the flanges. However, due to the shape and orientation of the flanges, any liquid striking the flanges will be deflected into the open mouths of the cans. Hence, it has been Applicant's experience that there is no uncontrolled splashing, either from the liquid striking the flanges or the surface of the liquid in the cans themselves, which might otherwise contaminate the outer surface of the cans.

In the disclosed embodiment, the cans C are shown as being tilted transversely to their direction of movement (FIGS. 3 and 4). This aspect per se is entirely conventional, and does not interfere with the fundamental operation of the improved apparatus. If the cans do not contain any solids and are to be entirely filled with liquid, such tilting is, as a practical matter, unnecessary since the cans themselves have a substantially constant volume (i.e., the variation in the volume from can-to-can is very small, and, for all intents and purposes, may be disregarded as negligible). On the other hand, if the cans are to be filled with a solid food product (e.g., beans, peas, etc.), and thereafter topped-off with liquid (e.g., brine, sauce, etc.), then a different problem is presented. In this instance, there may will be a relatively large variation in the volume of solids occupying the can before it is filled with liquid. Hence, the volume of the supplemental liquid needed to cover such solids and fill the cans to the desired depth, will also vary. In such a situation, the cans may be transversely tilted as they pass beneath the liquid sheet, and/or the flow of liquid or the translational speed of the cans, may be adjusted so that those cans containing the minimum volume of such solids will be just filled to the desired depth as they are passed beneath the length of the liquid sheet. Those cans which have a greater volume of solids will, of course, require a smaller volume of liquid to fill the can to the desired depth, and any excess liquid will simply pour from the lower edge portion of the tilted cans, without contaminating their outer surfaces. In other words, the lower edge portion of each tilted can, acts as a pour spout and direct any excess flow cleanly away from the can outer surface. It has been Applicant's experience that such pouring does not, therefore, contaminate the outer surfaces of the cans, and it is believed that the sub-laminar flow into the cans, coupled with there being no external air disturbance (as in U.S. Pat. No. 4,103,720), substantially contributes to the cleanness of such pouring.

Persons skilled in this art will readily appreciate that many factors contribute to whether, and to what extent, the descending flow of liquid along the guide plate is laminar or not. These factors include, inter alia, the approach surface velocity, the radius R of the weir outer surface 31, the roughness or smoothness of the weir outer surface and the guide plate, the viscosity of the serviced fluid, and the vertical height of the guide plate. The particular relationship between these variables is believed to be complex. Water, a classic Newtonian fluid, is actually one of the most difficult liquids to run with the improved apparatus because of its relatively-low viscosity. On the other hand, non-Newtonian liquids, such as sauces and the like, have a greater viscosity, and are comparatively easier to run.

Upon information and belief, it is presently thought that it is preferable to have the guide plate arranged substantially vertically (as shown), rather than inclined (as in said U.S. Patent No. 4,103,720). The perceived reason for this is that the gravitational acceleration will be in line with the direction of flow along the plate. In other words, the force of gravity will not have a component acting normal to the surface of the guide plate. It has been Applicant's experience that if the guide plate is inclined, the flow therealong will not be trapezoidal, as shown in FIG. 1 rather, the flow will tend to spread out. To accommodate this, said U.S. Pat. No. 4,103,720 deliberately provides vertical plates on the side of the inclined plate for the ostensible purpose of restraining such lateral flow. Thus, with a vertical plate, the only restriction to flow is the tangential drag force, and the liquid is not urged gravitationally toward the plate surface.

In one particular application, tank 14 had a length of 48 inches (121.92 cm) and a width of 8½" (21.59 cm). The tank, weir and guide plate were formed of stainless steel, which had been appropriately brushed and polished. The weir outer surface had a radius R of about 1.0 inch (2.54 cm), and the vertical height of the guide plate was about 8.0 inches (20.32 cm). The serviced liquid was brine. The flow over the weir was about 24 gallons per minute. The velocity of the falling sheet was calculated to be about 1.99 feet per second. In another case, a non-Newtonian tomato sauce flowed over the weir at about 38.4 gallons per minute. The velocity of the falling sheet was calculated to be about 1.49 feet per second. In both cases, cans translated beneath the guide plate were filled with liquid, substantially without contaminating the outer surfaces of cans translated therebeneath.

Thus, the salient of the invention is to provide a falling laminar or sub-laminar sheet of liquid, beneath which an endless stream of single-file open mouthed containers are passed. The width (w) of the stream is preferably about one-third of the extent of flange overlap, with any fluid striking the flanges being deflected back into the cans, as opposed to contaminating the outer surfaces thereof. Thus, as the cans are translated along the length of the liquid sheet, the cans are just filled with liquid to the desired depth, and without spillage. Importantly, the air jets taught by U.S. Pat. No. 4,103,720 are completely omitted as wholly unnecessary.

Of course, the invention specifically contemplates that many changes and modifications may be made. For example, the size, shape and dimensions of the tank, weir and guide plate may be readily varied. The flow to a tank of a particular configuration may be empirically determined, as a function of the serviced liquid, to yield optimum results. It has been Applicant's experience that the flow should be on the order of one-sixth to one-eighth of the maximum laminar flow, although these fractions include factors of safety and may be readily varied. Also, while Applicant prefers that the width (w) of the liquid sheet be about one-third of the extent of flange overlap (W), this relationship may also be varied.

Therefore, while the presently preferred embodiment of the improved apparatus has been shown and described, and several modifications and changes thereof discussed, persons skilled in this art will readily appreciate that various additional changes and modifications may be made without departing from the spirit of the invention, as defined and differentiated by the following claims.

I claim:

1. Apparatus for filling open-mouthed containers with a liquid, comprising:

a source of liquid;

a pump for supplying liquid from said source at a controllable flow;

a tank arranged to be supplied with liquid from said pump, said tank having a weir over which liquid may flow and having a guide plate arranged to guide the descent of liquid overflowing said weir, said guide plate having an upper end connected to said weir and having a lower end, said flow being so controlled with respect to the configuration of said weir and plate that liquid overflowing said weir will descend along said guide plate and fall from said plate lower end as a continuous sub-laminar rectangular sheet having a substantially-constant transverse cross-sectional width and length; and container moving means for selectively moving a multiplicity of series-abutting open-mouthed containers beneath said plate lower end and along the length of said sheet, the speed of said containers being such that said containers will be just filled with liquid to the desired depth as said containers are translated along the length of said sheet without said liquid contaminating the outer side surfaces of said containers.

2. The apparatus as set forth in claim 1 wherein each of said containers has an outwardly-extending flange about its open mouth, wherein the flange of adjacent containers are overlapped, and wherein the width of said sheet is less than the width of the overlap.

3. The apparatus as set forth in claim 2 wherein the width of said sheet is about one-third of the width of said overlap.

4. The apparatus as set forth in claim 1 wherein the flow over said weir is laminar.

5. The apparatus as set forth in claim 1 wherein the flow is from one-sixth to one-eighth of the maximum flow under which laminar conditions exist.

6. The apparatus as set forth in claim 2 wherein each of said flanges is configured such that any liquid falling on said flange will be deflected into the associated container.

7. The apparatus as set forth in claim 6 wherein each of said flanges is substantially frusto-conical.

8. The apparatus as set forth in claim 1 wherein the velocity of said liquid sheet will not produce splashing in said container.

9. The apparatus as set forth in claim 1 wherein said weir is a suppressed weir.

10. The apparatus as set forth in claim 1 wherein said weir has a rounded crest, and wherein said crest is so dimensioned and configured with respect to the flow supplied by said pump that the approach surface velocity of said liquid will not cause said liquid to separate from the rounded crest of said weir or said guide plate.

11. The method of filling a plurality of containers with liquid to a desired depth without contaminating the outer surface of said containers with said liquid, which method comprises the steps of:

arranging a multiplicity of open-mouthed containers each of said containers having an outwardly-extending flange portion about its mouth, in a series-abutting row such that the flange portions of two adjacent containers will be overlapped with respect to one another;

supplying liquid to a tank, said tank having a weir over which liquid may flow and having a guide plate arranged to guide the descent of liquid overflowing said weir, said guide plate having an upper end connected to said weir and having a lower end;

controlling the supply of liquid to said tank with respect to the configuration of said weir and plate that liquid overflowing said weir will descend along said guide plate and fall from said plate lower end as a continuous sub-laminar rectangular sheet having a substantially-constant transverse cross-sectional width and length; and moving said multiplicity of series-abutting containers along the length of said sheet such that each container will be just filled with said liquid to the desired depth without contaminating the outer surface of said container.

* * * * *